US010968740B2

(12) United States Patent
Buhr et al.

(10) Patent No.: US 10,968,740 B2
(45) **Date of Patent: *Apr. 6, 2021**

(54) INTERCHANGEABLE CHISEL HOLDER

(71) Applicant: Wirtgen GmbH, Windhagen (DE)

(72) Inventors: Karsten Buhr, Willroth (DE); Andreas Jost, Königswinter (DE); Thomas Lehnert, Oberraden (DE); Sebastian Hofrath, Hennef (DE); Martin Lenz, Großmaischeid (DE)

(73) Assignee: Wirtgen GmbH

( * ) Notice: Subject to any disclaimer, the term of this patent is extended or adjusted under 35 U.S.C. 154(b) by 0 days.

This patent is subject to a terminal disclaimer.

(21) Appl. No.: 16/472,923

(22) PCT Filed: Nov. 30, 2017

(86) PCT No.: PCT/EP2017/081016
§ 371 (c)(1),
(2) Date: Jun. 24, 2019

(87) PCT Pub. No.: WO2018/121955
PCT Pub. Date: Jul. 5, 2018

(65) Prior Publication Data

US 2019/0338639 A1 Nov. 7, 2019

(30) Foreign Application Priority Data

Dec. 30, 2016 (DE) ..... 10 2016 125 917.9

(51) Int. Cl.
*E21C 35/18* (2006.01)
*E01C 23/088* (2006.01)
(Continued)

(52) U.S. Cl.
CPC ..... *E21C 35/18* (2013.01); *E01C 23/088* (2013.01); *E01C 23/127* (2013.01);
(Continued)

(58) Field of Classification Search
CPC ..... E21C 35/183; E21C 35/1831; E21C 35/1833; E21C 35/191; E21C 35/193;
(Continued)

(56) References Cited

U.S. PATENT DOCUMENTS 3,614,164 A * 10/1971 Davis ..... E21C 35/19 299/83.1
3,834,764 A * 9/1974 Krekeler ..... E21C 35/18 299/108
(Continued)

FOREIGN PATENT DOCUMENTS

CN 1115994 A 1/1996
CN 1829581 A 9/2006
(Continued)

OTHER PUBLICATIONS

International Search Report from corresponding PCT/EP2017/081016, dated Feb. 8, 2018, 10 pages (not prior art).
(Continued)

*Primary Examiner* — Janine M Kreck
*Assistant Examiner* — Michael A Goodwin
(74) *Attorney, Agent, or Firm* — Lucian Wayne Beavers; Patterson Intellectual Property Law, PC

(57) ABSTRACT

The invention relates to an interchangeable chisel holder (40) which can be fixed to a milling drum (15) of a ground-working machine (10), having a forward chisel holder (42) for the interchangeable holding of a forward chisel (20), preferably a round-shaft chisel, and having a rearward chisel (30, 31), which is held on the interchangeable chisel holder (40), wherein, as based on a working movement (76) of the interchangeable chisel holder (40) when used in the ground-working machine (10), the rearward chisel (30, 31) is arranged behind the forward chisel holder (42). In such an interchangeable candleholder (40)
(Continued)

Figure 1:
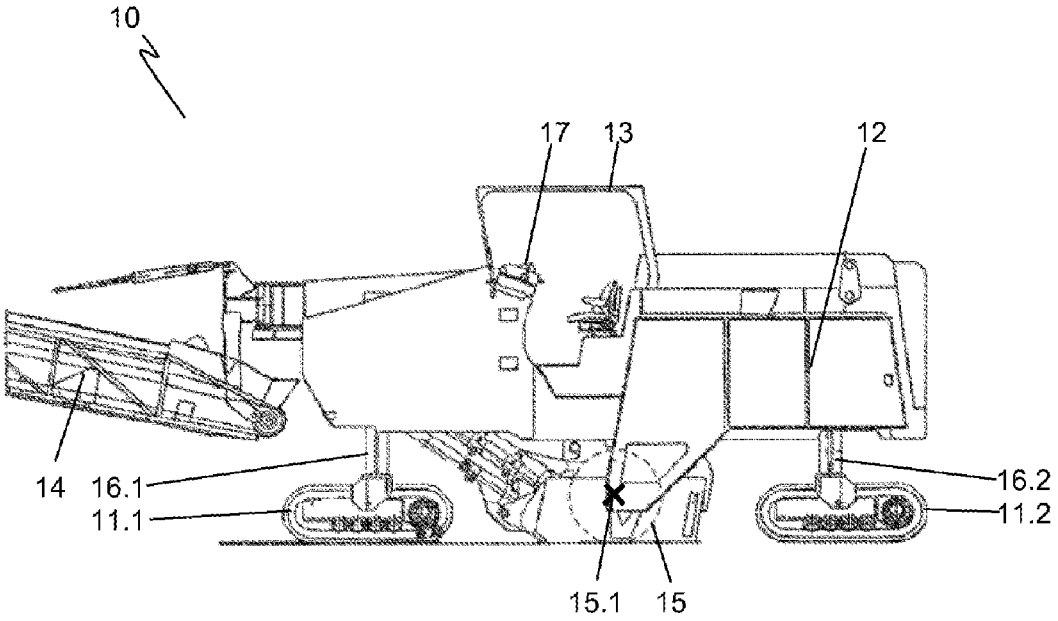

provision can be made, according to the invention, for the rearward chisel (30, 31) to be held on the interchangeable chisel holder (40) axially and fixed in the circumferential direction of the chisel holder. Maintenance-induced stoppages of the ground-working machine can thus be reduced and the loss of chisels can at least be lowered.

24 Claims, 4 Drawing Sheets

(51) Int. Cl.
*E21C 35/183* (2006.01)
*E01C 23/12* (2006.01)
*E21C 35/19* (2006.01)

(52) U.S. Cl.
CPC ..... *E21C 35/1833* (2020.05); *E21C 35/1835* (2020.05); *E21C 35/19* (2013.01); *E21C 35/183* (2013.01)

(58) Field of Classification Search
CPC .. E21C 35/1933; E21C 35/1936; E21C 35/18; E21C 35/1835; E21C 35/1837; E21C 35/19; E21C 35/197; E01C 23/088; E01C 23/127
See application file for complete search history.

(56) References Cited

U.S. PATENT DOCUMENTS 4,342,486 A 8/1982 O'Neill
4,349,232 A * 9/1982 Braun ..... E21C 35/18 299/109
4,674,802 A * 6/1987 McKenna ..... E21B 10/5673 299/112 R
5,374,111 A 12/1994 Den Besten et al.
5,582,468 A 12/1996 Latham
5,683,144 A * 11/1997 Kammerer ..... E21C 35/19 299/102
7,008,145 B2 3/2006 Astrakhan
7,300,115 B2 11/2007 Holl et al.
9,334,731 B2 5/2016 Jonker et al.
9,562,431 B2 2/2017 Fries et al.
10,648,330 B1 * 5/2020 Weaver ..... E21C 35/183
2001/0004946 A1 6/2001 Jensen
2007/0107273 A1 * 5/2007 Stoetzer ..... E02F 9/2866 37/450
2010/0052407 A1 * 3/2010 Cameron ..... E21C 35/183 299/111
2010/0141016 A1 6/2010 Yang
2014/0265530 A1 9/2014 Fries et al.
2015/0028654 A1 * 1/2015 Lehnert ..... E21C 25/10 299/39.4
2015/0211365 A1 * 7/2015 Hall ..... E21C 35/183 299/105
2016/0024920 A1 * 1/2016 Hall ..... E21C 25/10 299/39.8
2019/0316304 A1 10/2019 Buhr et al.

FOREIGN PATENT DOCUMENTS

CN 101175895 A 5/2008
CN 101418686 A 4/2009
CN 202611693 U 12/2012
CN 103205958 A 7/2013
CN 104024558 A 9/2014
CN 104160110 A 11/2014
CN 208440958 U 1/2019
DE 2946893 A1 6/1980
EP 758711 A2 2/1997
GB 2083855 A 3/1982
WO 2013064433 A2 5/2013

OTHER PUBLICATIONS

China Office Action for corresponding patent application No. 2017114594367, dated Dec. 28, 2017, 3 pages (not prior art).

* cited by examiner

INTERCHANGEABLE CHISEL HOLDER

The invention relates to an interchangeable chisel holder, which can be fastened to a milling drum of a soil tillage machine, having a leading chisel receiving fixture for the interchangeable holding of a leading chisel, preferably a round-shaft chisel, and having a trailing chisel, which is held on the interchangeable chisel holder, wherein the trailing chisel, based on a working movement of the interchangeable chisel holder when used in the soil tillage machine, is arranged after the leading chisel receiving fixture.

A tool combination is known from U.S. Pat. No. 4,342,486. The document shows a milling drum having a chisel holder designed to receive two milling chisels. The chisels are arranged one after the other in the rotational direction of the milling drum. A, in the rotational direction, front first chisel is arranged such that its chisel tip is moved on a larger radius about the rotational axis of the milling drum than the chisel tip of the trailing second chisel. The removal of the soil material is firstly realized by the engagement of the first chisel. After a fracture of the first chisel, the second chisel assumes the tillage task. The second chisel thus assumes a backup function, which enables further milling even in the event of damage to or loss of the first chisel and, at the same time, protection of the chisel holder and of the milling drum. To this end, the chisels are oriented parallel to one another. They are exchangeably connected to the chisel holder, so that they can be exchanged in the event of appropriate wear. Same chisels or chisels of different lengths, but with same holding mechanism for fastening to the chisel holder and same structure of the chisel tips, can here be provided.

Document U.S. Pat. No. 5,582,468 describes a chisel holder for a soil tillage machine, which chisel holder can be fixed to a milling drum. The chisel holder has two bores for the reception of two chisels. The chisels are arranged one after the other in the rotational direction of the milling drum. The bores are oriented obliquely to respectively a radial line of the milling drum and pointing in the rotational direction, so that the chisels strike at a desired angle the subsoil to be tilled. The bores are arranged, furthermore, on different radii, wherein the bore which is arranged further forward in the rotational direction lies on a smaller radius than the rear bore. A tip of a chisel accommodated in the rear bore is hence moved on a larger radius about the rotational axis of the milling drum than a tip of a structurally identical front chisel. The rear chisel takes over the bulk of the material removal. In the event of a fracture of the rear chisel, the material removal shifts to the front chisel. The front chisel is arranged such that it shields the bore and the outer rim of the rear bore in the motional direction of the chisels. The rear chisel receiving fixture, even in the event of fault with or loss of the rear chisel, is protected from excessive abrasive wear. The chisels are exchangeably connected to the chisel holder, so that they can be exchanged in the event of advanced wear or damage.

In WO 2013/064433 is described a chisel tip for a chisel as can be used for a soil tillage machine. The tip has a substrate which bears a polycrystalline diamond (PCD). The polycrystalline diamond forms the cutting edge of the chisel tip. Because of the great hardness of the polycrystalline diamond, the chisel has very low wear. As has been shown in use, in such an arrangement the chisel holder wears faster than the chisel itself. As a result, a chisel receiving fixture in which the chisel is held can be exposed and the chisel can get lost. Furthermore, it can happen that a used chisel, due to its, albeit low, wear in the connecting region, can no longer be installed into a new chisel holder. Owing to the diamond tipping, the chisels are very expensive to produce. As a result of lost or no longer usable chisels, the operating costs of the soil tillage machine rise significantly.

The object of the invention is to provide a tool for a soil tillage machine, which tool, given long maintenance intervals, enables cost-effective operation of the soil tillage machine.

The object of the invention is achieved by virtue of the fact that the trailing chisel is held on the interchangeable chisel holder such that it is fixed axially and in its circumferential direction.

In the case of such an interchangeable chisel holder, the trailing chisel can be formed by a special tillage tool which has a resistance to abrasion. Such chisels, by virtue of the brittle tip thereof, are particularly sensitive to intense shock stress and vibrations. It has been demonstrated that a risk of breakage of the trailing chisel is significantly reduced by the fixed attachment of the trailing chisel both in the axial direction as well as in the circumferential direction. Moreover, the trailing chisel can at least in regions be accommodated so as to be protected in the slipstream of the leading chisel. As a result of the greater hardness of the trailing chisel tip, combined with the reduced mechanical load, the service life of the trailing chisel can be extended such that it no longer, or only very seldom, has to be exchanged. The maintenance intervals are thus governed solely by the wearing of the leading chisel. Furthermore, the leading chisel protects the region in which the trailing chisel is held on the interchangeable chisel holder. Hence, the wearing of the interchangeable chisel holder in the joining region between the trailing chisel and the interchangeable chisel holder is significantly reduced. A loss of the trailing chisel can thus be avoided. As a result of the less frequently necessary maintenances and the avoidance of loss of the trailing chisels, the operating costs of the soil tillage machine can be significantly lowered.

In accordance with a particularly preferred design variant of the invention, it can be provided that the trailing chisel tip is formed, at least in some areas, of a superhard material, in particular of a diamond material, a diamond-reinforced material, a silicon carbide material, of cubic boron nitride, or of combinations of at least two of the aforementioned materials. Through the use of such a superhard material for the at least partial formation of the trailing chisel tip, the service life of the trailing chisel can be extended to the service life of the interchangeable chisel holder. An exchange of the trailing chisel is thus no longer necessary and the maintenance intervals of the chisels are governed solely by the wearing of the leading chisel. With the use of diamond materials or diamond-reinforced materials, extremely hardwearing chisels, which, even in the event of comparatively high mechanical load on the trailing chisel, have a service life proximate to the service life of the interchangeable chisel holder, can be provided. Chisel tips which are formed, at least in some areas, of a silicon carbide material or of cubic boron nitride, can be produced, on the other hand, more cost-effectively. They have, for arrangements and applications, for instance, in which the trailing chisel tip is exposed to a lower mechanical load, a life expectancy adapted to the length of use of the interchangeable chisel holder. Through appropriate combinations of said materials, the durability of the trailing chisel can be adapted to the expected load.

A very high mechanical load bearing capacity of the trailing chisel can be obtained by virtue of the fact that the diamond material is configured at least in part as a monocrystalline diamond, or as a polycrystalline diamond, or as a chemically separated diamond, or as a physically separated diamond, or as a natural diamond, or as an infiltrated diamond, or as a diamond layer, or as successive diamond layers, or as a thermally stable diamond, or as a silicon-bonded diamond. Through the use of monocrystalline diamond, chisel tips having very high mechanical stability can be obtained. Where polycrystalline diamonds or chemically or physically separated diamonds are used, degrees of hardness of the chisel tips which corresponds at least approximately to the hardness of monocrystalline diamonds can be achieved. Polycrystalline diamonds or chemically or physically separated diamonds can here by provided more cheaply in comparison to monocrystalline diamonds. As a result of infiltrated diamonds, the characteristics of the chisel tip can be adapted, within a set framework, to the expected requirements and loads. By means of diamond layers, the quantity of required diamond can be adapted to the actual needs, and hence the manufacturing costs reduced, via the adjustment of the layer thicknesses. As a result of successive diamond layers, the characteristics of the diamond layers can here be adapted to the respective requirements. In this way, an outer diamond layer, for instance, can be made very hard, and hence with high mechanical load-bearing capacity, while an inner diamond layer is adapted for a firm and durable connection to a substrate as that part of the chisel tip on which the diamond layers are separated. Thermally stable diamonds enable manufacturing processes for the chisel or chisel tip which demand high temperatures, for instance soldering processes. In the case of silicon-bonded diamond, small diamond segments are connected by means of silicon. The small diamond segments can be produced comparatively cheaply and can be present, for instance, as monocrystals. Silicon-bonded diamond can easily be adapted to the desired contour of the trailing chisel tip and its cutting edge.

A chisel tip which has a high load-bearing capacity and, at the same time, can be connected in a simple and mechanically stable manner to a further workpiece can be obtained by virtue of the fact that the trailing chisel tip is formed of a base support consisting of a hard material, preferably of carbide, which base support, facing toward the trailing cutting edge, is covered by the superhard material. The trailing cutting edge is thus formed by the superhard material. The base support consisting of the hard material can be soldered to a further portion of the trailing chisel, for instance a chisel head.

A cost-effective manufacture of the trailing chisel can be achieved by virtue of the fact that the superhard material is configured as a layer. The shape of the trailing chisel tip or of the trailing cutting edge can then, for instance, be predefined by the shape of a base support. The superhard material is applied to this in the form of a layer, whereby a very hard cutting edge is formed.

In accordance with a preferred design variant of the invention, it can be provided that the leading chisel is connected to the interchangeable chisel holder such that it is held axially and is rotatable in its circumferential direction. As a result of the rotatable mounting of the leading chisel, this, upon engagement in the soil material to be removed, is rotated about its longitudinal axis. This produces a uniform, circumferential wearing of the chisel tip and/or of the chisel head. The service life of the leading chisel can thus be increased. Furthermore, as a result of the uniform circumferential wear, a self-sharpening of the leading chisel occurs. This enables the leading chisel to penetrate comparatively easily into the material to be removed, so that the energy costs for the operation of the soil tillage machine fall.

As a result of the, at least in some areas, greater hardness of the trailing chisel tip, in particular in the case of a trailing chisel tip which is at least partially made of a superhard material, and as a result of the, in comparison to the leading chisel tip, lower mechanical load on the trailing chisel tip, an almost unchanged cutting engagement of the trailing chisel tip can be achieved over a long period. The life expectancy of the trailing chisel is hence proximate to the life expectancy of the interchangeable chisel holder. The life expectancy of the leading chisel, due to its lower hardness and its higher mechanical load during use, is less than that of the trailing chisel and of the interchangeable chisel holder. It can therefore be provided that the trailing chisel is connected to the interchangeable chisel holder such that it cannot be exchanged in a non-destructive manner, and/or that the leading chisel is exchangeably connected to the interchangeable chisel holder. The trailing chisel thus remains connected to the interchangeable chisel holder throughout the period of use thereof. The leading chisel, which is significantly cheaper to produce in comparison to the trailing chisel, can be exchanged once its wear limit is reached.

According to the invention, it can be provided that the trailing chisel is formed of the trailing chisel tip, which is directly connected in a non-detachable manner, in particular soldered, to the interchangeable chisel holder, and/or that the trailing chisel is formed at least of the trailing chisel tip and a shank indirectly or directly connected thereto, and that the shank is held in a trailing chisel receiving fixture of the interchangeable chisel holder, preferably by means of an integrally bonded, a non-positive or a positive connection. A trailing chisel formed only of the trailing chisel tip can be produced comparatively cheaply. The trailing chisel can here be formed from the base support consisting of a hard material, preferably of carbide, which, facing toward the trailing cutting edge, is covered by the superhard material. The base support can be directly connected to the chisel carrier. A robust and cost-effective connection is here able to be produced, for instance, by soldering. The base support is dimensioned such that it can be inserted into a production unit for connection to a superhard material. The thus produced chisel tip can be directly connected to the chisel carrier. It is likewise possible to connect the chisel tip directly or indirectly to a shank, for instance via a chisel head arranged between the chisel tip and the shank. The shank can then in the trailing chisel receiving fixture be connected to the chisel carrier. The connection between the shank and the chisel receiving fixture can be realized in an integrally bonded manner, for instance by soldering or gluing. Non-positive connections are likewise possible. Such a non-positive connection can be produced, for instance, by cold-stretching or shrink-fitting of the shank into the trailing chisel receiving fixture. The shank is here produced with an overmeasure, cooled and introduced into the trailing chisel receiving fixture. When heated, it expands and thus forms a fixed connection to the trailing chisel receiving fixture. Correspondingly, the connection can be produced by heat-shrinking, wherein the interchangeable chisel holder is heated and the shank of the trailing chisel, which shank is produced with an overmeasure, is plugged into the trailing chisel receiving fixture widened by the increased temperature. It is also conceivable to provide a screw connection between the shank and the interchangeable chisel holder.

A uniform milled surface pattern can be obtained by virtue of the fact that the trailing chisel is configured and arranged to rework a milling performed by the leading chisel. Through the reworking of the milling by the trailing chisel, the milled surface pattern is maintained irrespective of the state of wear of the leading chisel. This applies in particular to trailing chisels having respectively a trailing chisel tip equipped with a superhard material, which trailing chisel tips guarantee an almost unchanged cutting edge engagement over a long period.

A uniform milled surface pattern on the one hand, and a comparatively low mechanical load, and hence low wearing of the trailing chisel, on the other hand, can be achieved by virtue of the fact that the trailing chisel is configured and arranged to cut a, in relation to the leading chisel, smaller chip volume out of the material to be removed.

In order to rework the milling of the leading chisel by the trailing chisel, it can be provided that the leading chisel and the trailing chisel are configured, and arranged on the interchangeable chisel holder, such that, where a tool combination is fitted on a milling drum, the leading cutting edge of the leading chisel tip of the leading chisel is arranged on a larger radius to a rotational axis of the milling drum than is the trailing cutting edge of the trailing chisel tip of the trailing chisel, or that the two cutting edges are arranged on substantially equal radii. Substantially equal here means, in particular, radii which are equal to within ±3 mm. In this arrangement of the chisel tips, the trailing chisel removes a significantly smaller chip volume than the leading chisel. A uniform removal of the subsoil to be tilled can thereby be achieved, which results in a very uniform and homogeneous milled surface pattern. This is desirable, in particular, in precision milling, in which, for instance, an upper layer of a roadway is removed.

The leading chisel firstly penetrates into the subsoil to be tilled, followed by the trailing chisel. The paths on which the leading cutting edge and the trailing cutting edge are guided through the material to be worked are dependent on at least the milling depth, the rotation speed of the milling drum and the speed of advancement of the soil tillage machine. The material volume removed by each chisel thus depends at least on these machine parameters and on the relative arrangement of the trailing cutting edge of the trailing chisel to the leading cutting edge of the leading chisel. In order to obtain the desired uniform milled surface pattern, it can be provided that the distance between the cutting edges of the chisel tips, and the radii on which, where a tool combination is fitted on a milling drum, the cutting edges of the chisel tips are arranged, are chosen such that, given a predefined speed of advancement of the soil tillage machine and a predefined rotation speed of the milling drum, the trailing chisel has a predefined depth of penetration into the material to be milled. As a result of the mutually coordinated machine parameters and arrangement of the cutting edges, it can be achieved that the leading chisel cuts a larger volume than the trailing chisel. Hence, the leading chisel can be provided, for instance, for the roughing, and the trailing chisel for the finishing. The greatest part of the subsoil to be worked is here removed by the leading chisel, the desired milled surface pattern is produced by the trailing chisel.

An adaptation to standard machine parameters of the soil tillage machine can be achieved by virtue of the fact that the distance between the cutting edges of the leading chisel tip and of the trailing chisel tip measures between 45 mm and 75 mm, preferably between 50 mm and 60 mm, particularly preferably 54 mm, and/or that the radius on which, and where a tool combination is fitted on a milling drum, the trailing cutting edge of the trailing chisel tip is arranged is chosen between 1 mm and 7 mm, preferably between 2 mm and 5 mm, particularly preferably 3 mm, smaller than the radius on which the leading cutting edge of the leading chisel tip is arranged.

A conceivable invention variant is such that the trailing chisel (30, 31) is oriented at a smaller setting angle (74) in relation to a radial line (72) running through the trailing cutting edge (35) than is the longitudinal axis of the leading chisel receiving fixture (42) the leading chisel (20) in relation to a radial line (72) running through the leading cutting edge (23) and intersecting the longitudinal of the leading chisel receiving fixture (42), preferably such that the trailing chisel (30, 31) is oriented at a setting angle between 25° and 35°, and the longitudinal axis of the leading chisel receiving fixture (42) the leading chisel (20) at a setting angle between 35° and 45°, in relation to the respectively assigned radial line (72). As a result of the larger setting angle of the leading chisel, corresponding to the setting angle of the leading chisel receiving fixture, in particular between 35° and 45°, a self-sharpening of the leading chisel is achieved in all standard milling tasks. As a result of the smaller setting angle of the trailing chisel, in particular within a range between 25° and 35°, this is oriented in the direction of the resultant force, in particular in precision-milling.

In accordance with a particularly preferred design variant of the invention, it can be provided that a joining zone configured between the trailing chisel and the interchangeable chisel holder, along the working movement of the tool combination, is at least partially covered by the leading chisel, or a body region of the interchangeable chisel holder, or a wear protection element arranged between the interchangeable chisel holder and the leading chisel. By the leading chisel, the interchangeable chisel holder or the wear protection element, the removed soil material is thus slid past the joining zone configured between the trailing chisel and the interchangeable chisel holder. Excessive wearing of the interchangeable chisel holder in the region of the joining zone is thereby avoided. A loss of the trailing chisel can in this way be prevented.

The mechanical load on the trailing chisel, which latter may not be exchangeable in a non-destructive manner, can be kept low by virtue of the fact that the longitudinal axis of the leading chisel receiving fixture, transversely to the working movement of the interchangeable chisel holder, is displaced in relation to the trailing chisel tip. The soil material removed by the leading chisel is thus slid laterally past the trailing chisel. The service life of the trailing chisel can thereby be significantly increased. Preferably, the leading chisel protrudes beyond the trailing chisel on both sides.

Figure 2:
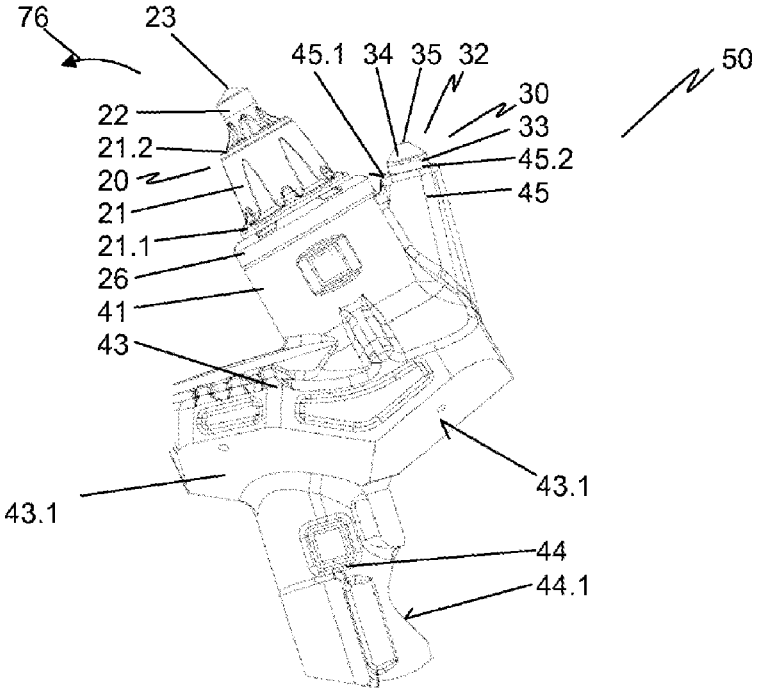
Figure 3:
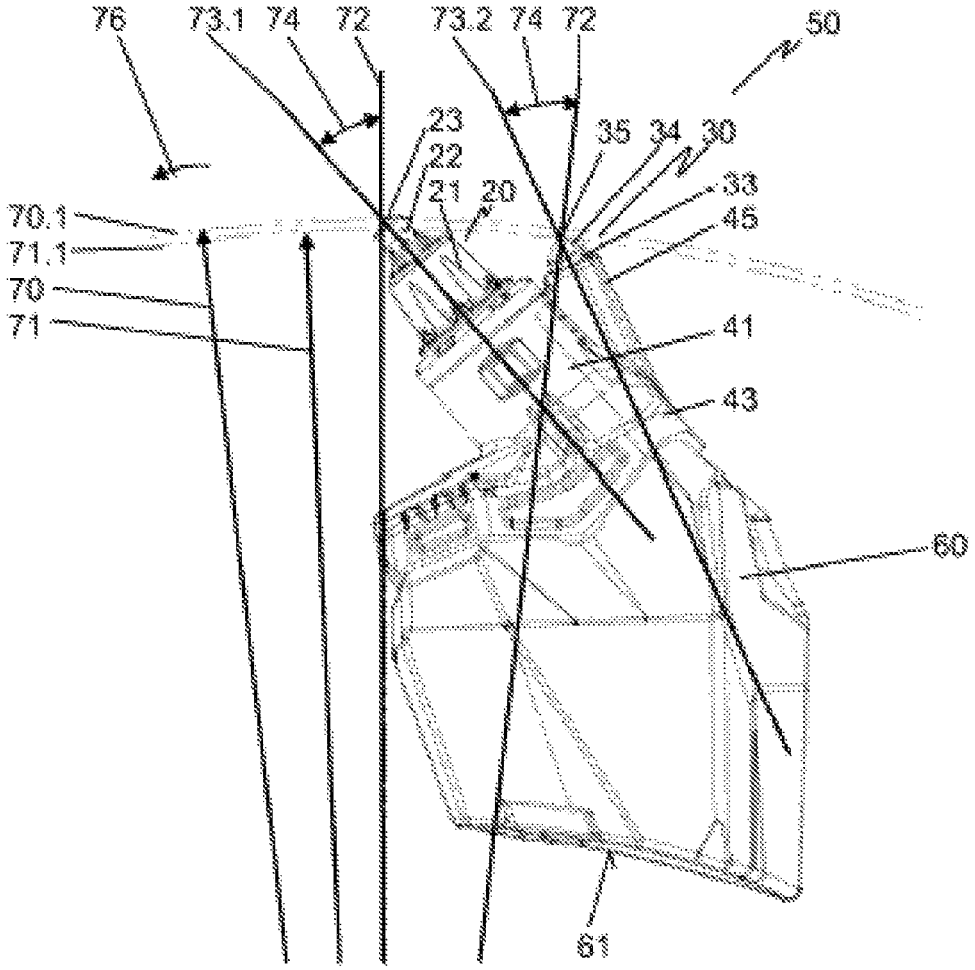
Figure 4:
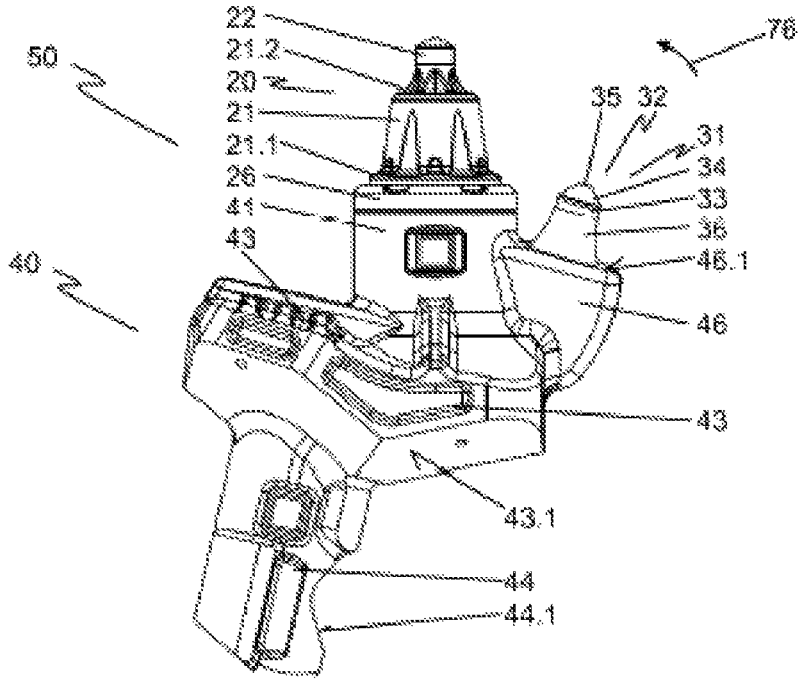
Figure 5:
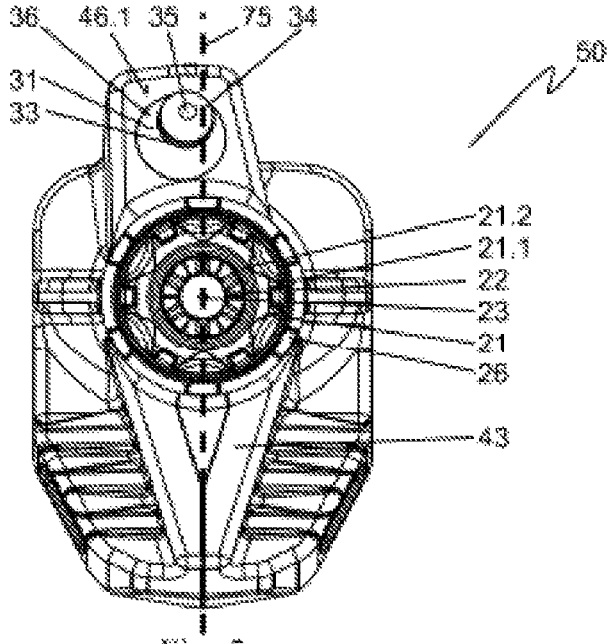
Figure 6:
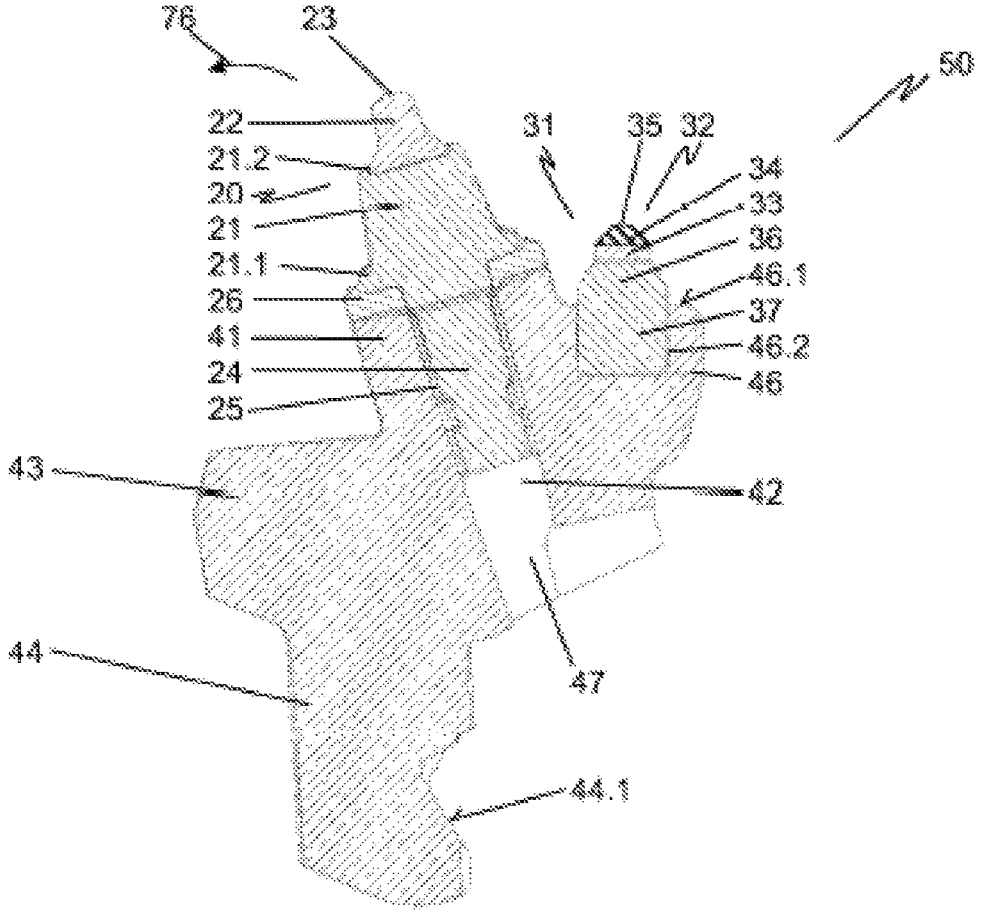

The invention is explained in greater detail below on the basis of an illustrative embodiment represented in the drawings, wherein:

FIG. 1 shows in schematic representation and side view an interchangeable soil tillage machine in the form of a road milling machine, FIG. 2 shows in a side view a tool combination comprising an interchangeable chisel holder, a leading chisel and a first trailing chisel, FIG. 3 shows in a side view the tool combination shown in FIG. 2, fitted on a base part, FIG. 4 shows in a side view a tool combination comprising an interchangeable chisel holder, a leading chisel and a second trailing chisel, FIG. 5 shows in a top view the tool combination shown in FIG. 4, and FIG. 6 shows in a lateral sectional representation the tool combination shown in FIGS. 4 and 5.

FIG. 1 shows in schematic representation and side view a soil tillage machine 10 in the form of a road milling machine. The soil tillage machine 10 may also be referred to as a soil working machine. A machine frame 12 is supported by running gears 11.1, 11.2, for instance chain drive assemblies, such that it is height-adjustable via four lifting columns 16.1, 16.2. The soil tillage machine 10 can be operated from a control station 13 via a control system 17 arranged in the control station 13. In a concealed milling drum box, a milling drum 15, which is likewise arranged in a concealed manner and in the illustration is drawn in dashed representation, is mounted rotatably about a rotational axis 15.1. A conveying device 14 serves for the evacuation of the milled material.

During use, the machine frame 12 is moved over the subsoil to be tilled at a speed of advancement inputted via the control system 17. Chisels 20, 30, 31 arranged on the rotating milling drum 15 and shown in FIGS. 2 to 6 hereupon remove the subsoil. The height position, and the rotation speed of the milling drum 15, can be set from the control system 17. Via the height position of the milling drum 15, the milling depth is set. The height position of the milling drum can here be realized, according to the machine type, via the height-adjustable lifting columns 16.1, 16.2. Alternatively, the milling drum 15 can be adjustable in height relative to the machine frame 12.

FIG. 2 shows in a side view a tool combination 50 comprising an interchangeable chisel holder 40, a leading chisel 20 and a first trailing chisel 30. The leading chisel 20 has a chisel head 21 and a chisel shank 24, integrally molded thereon and shown in FIG. 6. The chisel head 21 bears a leading chisel tip 22, consisting of a hard material, for instance of carbide. On its end, the leading chisel tip 22 forms a leading cutting edge 23.

The leading chisel tip 22 is usually soldered to the chisel head 21 along a contact surface. In the chisel head 21 is incorporated, for this purpose, a receiving fixture 21.2, into which the chisel tip 22 is inserted and soldered.

As shown in FIG. 6, the chisel shank 24 bears a longitudinally slotted, cylindrical clamping sleeve 25. This is held on the chisel shank 24 captively in the direction of the longitudinal extent of the leading chisel 22, yet such that it is freely rotatable in the circumferential direction. In the region between the clamping sleeve 25 and the chisel head 21 is arranged a wear protection disk 26. In the fitted state, the wear protection disk 26 is supported on a counter face of the interchangeable chisel holder 40 and, facing away from the interchangeable chisel holder 40, on the bottom side of the chisel head 21, which latter, in this region, is widened in terms of its diameter by a collar 21.1.

The interchangeable chisel holder 40 is equipped with a leading protrusion 41, in which, as shown in FIG. 6, is incorporated a leading chisel receiving fixture 42 in the form of a cylindrical bore. In this leading chisel receiving fixture 42, the clamping sleeve 25 is held clamped with its outer periphery on the bore inner wall. The leading chisel receiving fixture 42 opens out into an expulsion opening 47. Through this, a drift punch (not shown) can be introduced for the purpose of removing the leading chisel 20. Said drift punch acts on the end of the chisel shank 24 in such a way that, in overcoming the clamping force of the clamping sleeve 25, the leading chisel 20 is ejected from the leading chisel receiving fixture 42.

The leading protrusion 41 is molded onto a base 43 of the interchangeable chisel holder 40. Laterally offset and opposite to the leading protrusion 41, a plug connector 44 is integrally connected to the base 43. The plug connector 44 can be introduced into a plug socket of a base part 60 shown in FIG. 3 and clamped in place there by means of a clamping screw (not shown). For this, the plug connector 44 has a clamping surface 44.1, shown in FIG. 2, on which the clamping screw acts. To the side of the the plug connector 44, the base part 43 has a bearing surface 43.1, with which, in the fitted state, it is pressed under force action of the clamping screw against the base part 60 shown in FIG. 3. The base part 60 itself is welded via its bottom side 61 onto a milling drum tube of the milling drum 15 indicated in FIG. 1.

Through the rotation of the milling drum 15 and the advancement of the soil tillage machine 10, the tool combination 50 is moved in accordance with a working movement 76 indicated by an arrow. Based on this working movement 76, after the leading protrusion 41 a first trailing protrusion 45 is molded onto the base 43 of the interchangeable chisel holder 40. The leading protrusion 41 and the first trailing protrusion 45 are connected to one another along their mutually facing sides. At its end facing away from the base 43, the first trailing protrusion 45 forms a first front side 45.1. Molded into this first front side 45.1 is a solder recess 45.2. In the shown embodiment, the first trailing chisel 30 is formed merely of a trailing chisel tip 32. This has a base support 33. The base support is of cylindrical configuration. It is made of a hard material, in the present case of carbide. To the base support 33 is connected a superhard material 34, in the present case in the form of a polycrystalline diamond. The superhard material 34 forms, facing away from the base support 33, a trailing cutting edge 35. To this end, it is of conical configuration and, facing toward the base support 33, is adapted to the outer cylindrical contour thereof. As a result, the base support 33 is on its end completely covered by the superhard material 34. Opposite to the trailing cutting edge 35, the base support 33 is inserted in the solder recess 45.2 of the first trailing protrusion 45 and soldered to the latter.

FIG. 3 shows in a side view the tool combination 50 shown in FIG. 2, fitted on the base part 60. To this end, as already described with reference to FIG. 2, the interchangeable chisel holder 40 is plugged with its plug connector 44 into a socket of the base part 60 and fixed therein by means of a clamping screw. The base part 60 is along its bottom side 61 connected, in particular welded, to the milling drum tube (not represented in FIG. 3) of the milling drum 15 shown in FIG. 1.

Starting from the rotational axis 15.1, shown in FIG. 1, of the milling drum 15, a larger radius 70 and a smaller radius 71 are represented by corresponding arrows. The larger radius 70 marks a larger cutting circle 70.1, and the smaller radius 71 a smaller cutting circle 71.1. The leading cutting edge 23 of the leading chisel 20 is arranged on the larger radius 70. The trailing cutting edge 35 of the first trailing chisel 30 lies on the smaller radius 71. Upon rotation of the milling drum 15 along the working movement 76 marked by the arrow, the leading cutting edge 23 of the leading chisel 20 is thus moved along the larger cutting circle 70.1, and the trailing cutting edge 35 of the first trailing chisel 30 along the smaller cutting circle 71.1, without any advancement of the soil tillage machine 10.

Starting from the rotational axis 15.1 of the milling drum 15, two radial lines 72 are respectively run through the leading cutting edge 23 of the leading chisel 20 and the trailing cutting edge 35 of the first trailing chisel 30. They there cross a leading center line 73.1 of the leading chisel 20 or a trailing center line 73.2 of the first trailing chisel 30. The leading center line 73.1 is oriented along the axis of symmetry of the leading chisel 20 in the direction of the longitudinal extent thereof. Correspondingly, the trailing center line 73.2 runs along the axis of symmetry of the first trailing chisel 30. The leading center line 73.1 indicates the orientation of the leading chisel 20, while the trailing center line 73.2 marks the orientation of the first trailing chisel 30. The leading chisel 20 and the first trailing chisel 30 are oriented respectively at a setting angle 74, marked by a double arrow, in relation to the associated radial line 72. The setting angle 74 of the first trailing chisel 30 is here chosen smaller than the setting angle 74 of the leading chisel 20.

In FIG. 4, a tool combination 50 comprising an interchangeable chisel holder 40, a leading chisel 20 and a second trailing chisel 31 is shown in a side view. The structure of the leading chisel 20 and its fastening to the interchangeable chisel holder 40 correspond to the previously described structure and the previously described fastening respectively, so that reference is made to this description. The leading protrusion 41, the base 43 and the plug connector 44 also correspond to the description relating to FIGS. 2, 3 and 6.

The second trailing chisel 31 has a pedestal 36, which is integrally connected to a shank 37 shown in FIG. 6. Starting from the cylindrically configured shank 37, the pedestal 36 tapers up to the diameter of the base support 33 of the trailing chisel tip 32. The pedestal 36 is formed of a hard material, in the present case of carbide. The base support 33 of the trailing chisel tip 32 is fitted onto the pedestal 36 and connected, in particular soldered, thereto. Opposite to the pedestal 36, a superhard material 34, in the present case in the form of a polycrystalline diamond, covers the base support 33. The superhard material 34 is here fixedly connected to the base support 33. Facing away from the base support 33, the superhard material 34 forms the trailing cutting edge 35 of the second trailing chisel 31. As represented in FIG. 6, the shank 37 of the second trailing chisel 31 is held in a trailing chisel receiving fixture 46.2. The trailing chisel receiving fixture 46.2 is here configured as a bore in a second trailing protrusion 46 of the interchangeable chisel holder 40. The trailing chisel receiving fixture 46.2, starting from a second front side 46.1 of the second trailing protrusion 46, is here molded into the latter. The shank 37 of the second trailing chisel 31 is fixed, both in the circumferential direction and axially, in the trailing chisel receiving fixture 46.2. The non-positive connection between the shank 37 and the trailing chisel receiving fixture 46.2 is realized in the present case by means of cold-stretching or shrinking. To this end, the shank 37 is produced with an interference fit in relation to the trailing chisel receiving fixture 46.2. For the joining, the shank 37 is cooled to the point where it can be inserted into the trailing chisel receiving fixture 46.2. When the shank 37 is subsequently heated, it expands due to thermal expansion, so that a non-positive connection is formed between the shank 37 and the trailing chisel receiving fixture 46.2. Besides the non-positive connection of the shank 37 to the trailing chisel receiving fixture 46.2 by means of cold-stretching or shrinking, other non-positive, positive or integrally bonded combinations are also conceivable. These can be realized, for instance, as a screwed joint, as a soldered joint, as a welded joint, or as an adhesive joint. Preferably, the shank 37 is also formed of a hard material, in particular of carbide. The screwed joint and the welded joint are examples of positive connections. The soldered joint and the adhesive joint are examples of integrally bonded connections.

The second trailing protrusion 46 is arranged, based on the working movement 76 of the material combination 50, after the leading protrusion 41. Hence also the second trailing chisel 31, based on the working movement 76, is positioned after the leading chisel 20. When the tool combination 50 is fitted, the leading cutting edge 23 is arranged on the larger radius 70, and the trailing cutting edge 35 of the second trailing chisel 31 on the smaller radius 71, as is shown in FIG. 3 for a tool combination 50 comprising a first trailing chisel 30. The second trailing chisel 31 is likewise oriented at a smaller setting angle 74 (see FIG. 3) in relation to an associated radial line 72 than the leading chisel 20.

FIG. 5 shows in a top view the tool combination 50 shown in FIG. 4. Same components are here, as previously adopted, identically labeled.

A center plane 75 of the tool combination 50 is marked by a dashed line. The center plane 75 here relates to the plug connector 44, the base 43 and the leading protrusion 41 of the interchangeable chisel holder 40, as well as to the leading chisel 20. It hence runs through the center of the leading chisel tip 22. The second trailing chisel 31 is arranged laterally offset from the center plane 75. This enables the tool combination 50 comprising the two chisels 20, 30, 31 to be fastened to the milling drum 15 such that it is obliquely inclined in the direction of the longitudinal extent of this same, wherein the second trailing chisel 31, upon rotation of the milling drum 15, follows the path of the leading chisel 20. As a result of the oblique arrangement, it is achieved that the leading chisel 20 mounted rotatably about its central longitudinal axis penetrates obliquely into the soil material to be removed. This has the effect that the leading chisel 20 rotates about its center longitudinal axis and is hence evenly worn along its periphery.

FIG. 6 shows in a lateral sectional representation the tool combination 50 shown in FIGS. 4 and 5. As previously described, the leading chisel 20 is held in the leading chisel receiving fixture 42 of the interchangeable chisel holder 40 such that it is rotatable on its chisel shank 24 by means of the clamping sleeve 25, but axially blocked. The second trailing chisel 31 is fixed with its shank 37 in the trailing chisel receiving fixture 46.2 of the second trailing protrusion such that it is blocked both in the circumferential direction and axially.

In the tool combinations 50 shown in FIGS. 2 to 6, the leading chisel 20 and the respective trailing chisel 30, 31 are arranged relative to one another such that, when a tool combination 50 is fitted on a milling drum 15, the trailing chisel 30, 31 is moved along the same milling line as the leading chisel 20. The respective trailing chisel 30, 31 is thus, based on the working movement 76 of the tool combination 50, arranged after the leading chisel 20. The trailing chisel 30, 31 is hence arranged protected by the leading chisel 20.

Transversely to the working movement 76, the leading chisel 20 is dimensioned larger than the trailing chisel 30, 31, so that it protrudes beyond the latter on both sides. As a result, the soil material removed by the leading chisel 20 is guided predominantly past the trailing chisel 30, 31. Likewise, the leading chisel 20 and/or the wear protection disk 26 and/or the leading protrusion 41 covers the joining region between the trailing chisel 30, 31 and the trailing protrusion 45, 46 of the interchangeable chisel holder 40 along the working movement 76. The joining region between the trailing chisel 30, 31 and the trailing protrusion 45, 46 of the interchangeable chisel holder 40 is thus protected from high abrasive wear. It can thereby reliably be avoided that the trailing protrusion 45, 46 washes out and the joining surface between the trailing chisel 30, 31 and the trailing protrusion 45, 46 is exposed. A situation in which the trailing chisel 30, 31 gets lost due to the wearing of the interchangeable chisel holder 40 is hence avoided.

The trailing chisel tip 32 of the trailing chisel 30, 31 is at least partially formed of a superhard material. The trailing chisel tip 32 is hence configured harder in comparison to the leading chisel tip 22 of the leading chisel 20, which is preferably made of a carbide. The trailing chisel tip 32, and hence the trailing chisel 30, 31, are thus configured significantly more resistant to abrasively induced wear than the leading chisel tip 22, and hence the leading chisel 20. Combined with the previously described, protected arrangement of the trailing chisel 30, 31, this has a significantly longer service life than the leading chisel 20. Given appropriate design and arrangement of the trailing chisel 30, 31, the service life of the trailing chisel 30, 31 lies in the order of magnitude of the service life of the interchangeable chisel holder 40. As a result, the trailing chisel 30, 31 cannot be exchangeably connected to the interchangeable chisel holder 40, in particular cannot be connected to the interchangeable chisel holder 40 such that it cannot be exchanged in a non-destructive manner. By contrast, the leading chisel 20, which is exposed to heavy mechanical wear, is fastened in an easily exchangeable manner to the interchangeable chisel holder 40. In the event of a worn leading chisel 20, this can thus be easily exchanged. Since the trailing chisel 30, 31, due to its long service life, no longer has to be exchanged, maintenances involving corresponding stoppage times of the soil tillage machine 10 shall be provided only for the exchange of the leading chisel 20. The operating costs of the soil tillage machine 10 can thereby be kept low.

The superhard material is in the present case realized as a polycrystalline diamond. In accordance with the present invention, it can also be formed as a diamond material, as a diamond-reinforced material, as a silicon carbide material, as a cubic boron nitride, or as combinations of at least two of the aforementioned materials. All these materials or material combinations have a greater hardness than the carbide from which the leading chisel is produced, and hence a greater resistance to wear. Besides the polycrystalline diamond, a monocrystalline diamond, chemically separated diamond, physically separated diamond, natural diamond, infiltrated diamond, one or more successive diamond layers, thermally stable diamond, or silicon-bonded diamond can also be used as the diamond material.

During a milling process, the tool combination 50, due to the rotation of the milling drum 15 and the advancement of the soil tillage machine 10, is moved through the soil material to be removed. The trailing cutting edge 35 of the trailing chisel 30, 31 is arranged, based on the rotational axis 15.1 of the milling drum 15, on a smaller radius 71, or a same radius as the leading cutting edge 23 of the leading chisel 20. Hence, and as a result of the diminished geometry of the trailing chisel 30, 31 in relation to the leading chisel 20, the leading chisel 20 cuts a larger volume than the trailing chisel 30, 31. According to the invention, the trailing chisel 30, 31 is designed and arranged to rework the milling of the leading chisel 20. In particular, a coarser milling is performed by the leading chisel 20, and a finer milling by the trailing chisel 30, 31. Correspondingly, the trailing cutting edge 32 of the trailing chisel 30, 31 is spatially arranged in such a way in relation to the leading cutting edge 23 of the leading chisel 20 that, given predefined operating parameters of the soil tillage machine 10, each of the chisels 20, 30, 31 has a customized depth of penetration into the soil material.

For the performance of a fine milling, a depth of penetration of less than 15 mm, for instance, is suitable for the trailing chisel 30, 31. Typical operating parameters of the soil tillage machine 10 for such a milling process are a rotation speed of the milling drum 15 of 130 r.p.m., a speed of advancement of the soil tillage machine 10 of 20 m/min, and a milling depth of 100 mm. The larger cutting circle 70.1 of the leading cutting edge 23 measures, for instance, around 980 mm. From the milling depth of 100 mm and the larger cutting circle 70.1, a milling angle of 37.25°, within which the chisels 20, 30, 31, when the soil tillage machine 10 is operated with forward travel, engage in the soil material. From the engagement of the tool combination into the soil through to its exit from the soil, the soil tillage machine 10 moves forward about 15 mm. In order to obtain a desired cutting depth of the trailing chisel 30, 31 of, for example, 12 mm, as is suitable for the performance of a precision-milling, the smaller radius 71 on which the trailing cutting edge 35 of the trailing chisel 30, 31 is arranged must hence be chosen to be 3 mm smaller than the larger radius 70 on which the leading cutting edge 23 of the leading chisel 20 is arranged. Through the suitable arrangement of the trailing cutting edge 35 of the trailing chisel 30, 31, based on the leading cutting edge 23 of the leading chisel 20, the depth of penetration of the trailing chisel into the soil material can thus be set and predefined for predefined operating parameters of the soil tillage machine 10. It thereby becomes possible for the leading chisel 20 to execute, for example, a coarse milling task, for instance roughing, while the trailing chisel 30, 31 is designed for a precision milling, for instance finishing. The trailing chisel 30, 31 thus reworks the milling of the leading chisel 20. It hence determines the obtained milled surface pattern. Due to the very low wearing of the trailing chisel 30, 31, this milled surface pattern remains at least broadly the same, even after lengthy period of use of the tool combination 50 and high wearing of the leading chisel 20.

The leading chisel 20 is held in the leading chisel receiving fixture 42 of the interchangeable chisel holder 40 such that it is rotatable about its center longitudinal axis. When the leading chisel 20 engages in the removed soil material, it is rotated about its center longitudinal axis. The leading chisel 20 hence becomes evenly worn over its periphery, whereby its service life is significantly extended. By contrast, the trailing chisel 30, 31 is non-rotatably connected to the interchangeable chisel holder 40. Due to the extreme hardness of the trailing chisel tip 32, only minor wearing of the trailing chisel 30, 31 occurs, so that no rotatable mounting of the trailing chisel 30, 31 is necessary. As a result of the rigid connection of the trailing chisel 30, 31 to the interchangeable chisel holder 40, vibrations in the trailing chisel tip 32 can be avoided. Such vibrations can lead to the fracture of the superhard material 34.

The invention claimed is:

1. An interchangeable chisel holder apparatus, comprising:

a chisel holder configured to be fastened to a milling drum of a soil working machine, the chisel holder including:

a base;

a plug connector integrally connected to and extending from one side of the base;

a leading protrusion integrally connected to the base and including a leading chisel receiving fixture extending from another side of the base and including a leading chisel receiving bore configured to interchangeably hold a leading chisel;

a trailing chisel receiving fixture including a bore; and wherein the base, the plug connector and the leading protrusion have a common center plane including a longitudinal axis of the leading chisel receiving bore, and the bore of the trailing chisel receiving fixture is asymmetrically laterally offset from the center plane; and a trailing chisel mounted on the chisel holder after the leading chisel receiving fixture, the trailing chisel including a trailing chisel tip and a shank connected indirectly or directly to the trailing chisel tip, the shank of the trailing chisel being received in the bore of the trailing chisel receiving fixture such that the trailing chisel is fixed axially and in a circumferential direction of the trailing chisel, and such that the trailing chisel is asymmetrically laterally offset from the center plane.

2. The apparatus of claim 1, wherein:

the leading chisel receiving fixture is configured to interchangeably hold a round-shank chisel.

3. The apparatus of claim 1, wherein:

the trailing chisel includes the trailing chisel tip formed, at least in some areas, of a superhard material.

4. The apparatus of claim 3, wherein the superhard material is selected from the group consisting of:

a diamond material;

a diamond-reinforced material;

a silicon carbide material;

cubic boron nitride; and combinations of at least two of the aforementioned materials.

5. The apparatus of claim 3, wherein the superhard material includes at least in part a diamond material selected from the group consisting of:

a monocrystalline diamond;

a polycrystalline diamond;

a chemically separated diamond;

a physically separated diamond;

a natural diamond;

an infiltrated diamond;

a diamond layer;

successive diamond layers;

a thermally stable diamond; and a silicon-bonded diamond.

6. The apparatus of claim 3, wherein:

the trailing chisel includes the trailing chisel tip and a trailing cutting edge; and the trailing chisel tip includes a base support formed of a carbide material, the base support facing toward the trailing cutting edge being covered by the superhard material.

7. The apparatus of claim 3, wherein:

the superhard material is configured as a layer.

8. The apparatus of claim 1, wherein:

the trailing chisel is connected in a non-exchangeable manner to the chisel holder.

9. The apparatus of claim 1, wherein:

the trailing chisel includes the trailing chisel tip soldered to the chisel holder so that the trailing chisel tip is directly and non-detachably connected to the chisel holder.

10. The apparatus of claim 1, wherein:

the shank is held in the trailing chisel receiving fixture by a connection selected from the group consisting of:

an integrally bonded connection;

a non-positive connection; and a positive connection.

11. The apparatus of claim 1, wherein:

the leading chisel is received in the leading chisel fixture; and the trailing chisel is configured and arranged to rework a milling performed by the leading chisel.

12. The apparatus of claim 1, wherein:

the leading chisel is received in the leading chisel fixture; and the trailing chisel is configured and arranged to cut a smaller chip volume than is the leading chisel.

13. The apparatus of claim 1, wherein:

the leading chisel is received in the leading chisel fixture, the leading chisel including a leading chisel tip and a leading cutting edge;

the trailing chisel includes the trailing chisel tip and a trailing cutting edge; and the chisel holder is mounted on the milling drum and the leading chisel and the trailing chisel are configured and arranged on the chisel holder such that the leading cutting edge of the leading chisel tip is arranged on a larger radius from a rotational axis of the milling drum than is the trailing cutting edge of the trailing chisel tip.

14. The apparatus of claim 1, wherein:

the leading chisel is received in the leading chisel fixture, the leading chisel including a leading chisel tip and a leading cutting edge;

the trailing chisel includes the trailing chisel tip and a trailing cutting edge; and the chisel holder is mounted on the milling drum and the leading chisel and the trailing chisel are configured and arranged on the chisel holder such that the leading cutting edge of the leading chisel tip and the trailing cutting edge of the trailing chisel tip are arranged on radii equal to within ±3 mm from a rotational axis of the milling drum.

15. The apparatus of claim 1, wherein:

the leading chisel is received in the leading chisel fixture, the leading chisel including a leading chisel tip and a leading cutting edge;

the trailing chisel includes the trailing chisel tip and a trailing cutting edge;

the chisel holder is mounted on the milling drum and the leading chisel and the trailing chisel are configured and arranged on the chisel holder such that the leading cutting edge of the leading chisel tip and the trailing cutting edge of the trailing chisel tip are arranged at first and second radii, respectively, from a rotational axis of the milling drum; and the first and second radii and a distance between the leading cutting edge and the trailing cutting edge are such that given a predefined speed of advancement of the soil working machine and a predefined rotation speed of the milling drum, the trailing chisel has a predefined depth of penetration into a material to be milled.

16. The apparatus of claim 1, wherein:

the leading chisel is received in the leading chisel fixture, the leading chisel including a leading chisel tip and a leading cutting edge;

the trailing chisel includes the trailing chisel tip and a trailing cutting edge;

a distance between the leading cutting edge and the trailing cutting edge is in a range of from 45 mm to 75 mm; and the chisel holder is mounted on the milling drum and the leading chisel and the trailing chisel are configured and arranged on the chisel holder such that the leading cutting edge of the leading chisel tip is arranged on a larger radius from a rotational axis of the milling drum and the trailing cutting edge of the trailing chisel tip is arranged on a smaller radius from the rotational axis of the milling drum, the smaller radius being from 1 mm to 7 mm smaller than the larger radius.

17. The apparatus of claim 16, wherein:

the distance between the leading cutting edge and the trailing cutting edge is in a range of from 50 mm to 60 mm.

18. The apparatus of claim 16, wherein:

the smaller radius is from 2 mm to 5 mm smaller than the larger radius.

19. The apparatus of claim 1, wherein:

the leading chisel is received in the leading chisel fixture, the leading chisel including a leading chisel tip and a leading cutting edge;

the trailing chisel includes the trailing chisel tip and a trailing cutting edge; and the chisel holder is mounted on the milling drum and the leading chisel and the trailing chisel are configured and arranged on the chisel holder such that a setting angle of the trailing chisel relative to a radial line running from a rotational axis of the milling drum through the trailing cutting edge is smaller than a setting angle of the leading chisel relative to a radial line running through the leading cutting edge.

20. The apparatus of claim 19, wherein:

the setting angle of the trailing chisel is between 25° and 35°; and the setting angle of the leading chisel is between 35° and 45°.

21. The apparatus of claim 1, wherein:

the leading chisel is received in the leading chisel fixture;

the chisel holder is mounted on the milling drum; and the chisel holder includes a joining zone where the trailing chisel is joined to the chisel holder, and the joining zone is at least partially covered by the leading chisel in a direction of a working movement of the chisel holder from the trailing chisel.

22. The apparatus of claim 1, wherein:

the leading chisel is received in the leading chisel fixture;

the chisel holder is mounted on the milling drum; and the chisel holder includes a joining zone where the trailing chisel is joined to the chisel holder, and the joining zone is at least partially covered by a body region of the chisel holder in a direction of a working movement of the chisel holder from the trailing chisel.

23. The apparatus of claim 1, wherein:

the leading chisel is received in the leading chisel fixture;

a wear protection element is arranged between the leading chisel fixture and the leading chisel;

the chisel holder is mounted on the milling drum; and the chisel holder includes a joining zone where the trailing chisel is joined to the chisel holder, and the joining zone is at least partially covered by the wear protection element in a direction of a working movement of the chisel holder from the trailing chisel.

24. The apparatus of claim 1, wherein:

the leading chisel is received in the leading chisel fixture; and the chisel holder is mounted on the milling drum and the leading chisel and the trailing chisel are configured and arranged on the chisel holder such that the trailing chisel follows the path of the leading chisel as the milling drum rotates.

* * * * *